US006463869B2

(12) United States Patent
Smith

(10) Patent No.: US 6,463,869 B2
(45) Date of Patent: Oct. 15, 2002

(54) RECIPROCATING BARGE COUPLING DEVICE

(76) Inventor: Gregory L. Smith, 2616 SE. Front St., Hoxie, AR (US) 72433

( * ) Notice: Subject to any disclaimer, the term of this patent is extended or adjusted under 35 U.S.C. 154(b) by 0 days.

(21) Appl. No.: 09/853,730

(22) Filed: May 10, 2001

(65) Prior Publication Data

US 2001/0039909 A1 Nov. 15, 2001

Related U.S. Application Data

(60) Provisional application No. 60/203,393, filed on May 11, 2000.

(51) Int. Cl.[7] ..... B63B 21/58
(52) U.S. Cl. ..... 114/249
(58) Field of Search ..... 114/242, 230.1, 114/248, 249

(56) References Cited

U.S. PATENT DOCUMENTS

| | | | | |
|---|---|---|---|---|
| 3,800,733 A | * | 4/1974 | West | 114/250 |
| 3,844,245 A | * | 10/1974 | Yamaguchi | 114/248 |
| 3,938,461 A | | 2/1976 | Marriner | 114/235 R |
| 3,981,517 A | | 9/1976 | Crochet | 280/478 |
| 4,066,033 A | | 1/1978 | Milone | 114/235 R |
| 4,521,044 A | | 6/1985 | Appleman et al. | 294/82.24 |
| 5,150,744 A | | 9/1992 | Havashi et al. | 114/230 |
| 5,423,632 A | | 6/1995 | Ekvall et al. | 405/223.1 |
| 5,439,324 A | | 8/1995 | Ekvall et al. | 405/202 |
| 5,493,991 A | | 2/1996 | Wright et al. | 114/230 |
| 5,540,541 A | * | 7/1996 | Gosdowski et al. | 414/744.5 |

* cited by examiner

*Primary Examiner*—Stephen Avila
(74) *Attorney, Agent, or Firm*—John M Harrison

(57) ABSTRACT

A reciprocating barge coupling device for removably coupling adjacent barges floating on a water body and allowing vertical movement of the barges with respect to each other typically due to the wave-induced rise and fall of the barges. In a preferred embodiment the reciprocating barge coupling device is characterized by a pair of coupling units of substantially identical construction mounted on the responsive barges, each of which coupling units is fitted with an elongated, vertical coupling channel and a T-bolt. In application, the barges are positioned in adjacent, end-to-end relationship to each other, with the vertical coupling channels of the respective coupling units in substantially aligned, facing relationship with respect to each other. The T-bolt of one of the coupling units can be selectively extended through the registering coupling channels of both coupling units, rotated to cause engagement of the T-bolt head with the opposite coupling unit and locked in place, to removably couple the barges to each other. Accordingly, the extended T-bolt is capable of bidirectional vertical movement in the coupling channel of the receiving coupling unit, and the floating barges remain coupled to each other as the barges rise and fall with respect to each other in the water.

20 Claims, 7 Drawing Sheets

RECIPROCATING BARGE COUPLING DEVICE

CROSS-REFERENCE TO RELATED APPLICATIONS

This application claims the benefit of copending U.S. provisional application No. 60/203,393, filed May 11, 2000.

BACKGROUND OF THE INVENTION

Field of the Invention

This invention relates to devices for coupling marine vehicles to each other and more particularly, to a reciprocating barge coupling device for removably coupling adjacent barges in a barge string floating on a water body and allowing vertical movement of the coupled barges with respect to each other due to the typically wave-induced rise and fall of the barges in the water. In a preferred embodiment the reciprocating barge coupling device is characterized by substantially identical first and second coupling units mounted on the respective barges, each of which coupling units is fitted with an elongated, vertical coupling channel and a T-bolt. In application, the floating barges are positioned in adjacent, end-to-end relationship to each other, with the vertical coupling channel of the first coupling unit in substantially aligned and facing relationship with respect to the vertical coupling channel of the second coupling unit. The T-bolt of the coupling unit which is mounted on the lower of the two barges can be selectively extended through the aligned coupling channels of both couplings units and rotated to cause engagement of the T-bolt head with the opposite coupling unit, mounted on the higher barge, and the T-bolt locked in place to removably couple the barges to each other. If the barges are substantially the same height, the T-bolt of either coupling unit can be used in the coupling operation. Accordingly, the extended coupling shaft is capable of bidirectional vertical movement in the coupling channel of the receiving coupling unit, and the barges remain coupled to each other as the floating barges rise and fall with the waves in the water. Typically, a pair of the coupling units is provided at each end of each barge, in spaced-apart relationship to each other for engaging the respective coupling units on the adjacent end of the other barge. Because the firs and second coupling units are substantially identical in construction, they are capable of reciprocal usage because either coupling unit can function as the "male" component and the other as the "female" component of the coupling device. This capability is essential under circumstances in which barges having different deck heights must be coupled, due to the possibility of the T-bolt of one of the coupling units being positioned at a higher level than the coupling channel of the opposite coupling unit. Accordingly, the T-bolt of the coupling unit of the lower barge is capable of interfacing with the coupling channel of the coupling unit of the higher barge, irrespective of which coupling unit is mounted on which barge.

In the past, barges have commonly been coupled for transport on a water body by connecting adjacent barges using wire cables and tightening the cables typically using ratchets or winches. However, this mechanism hindered vertical movement of the barges with respect to each other with the wave-induced rise and fall of the water, and the resultant strain on the cables frequently caused the cables to break. Accordingly, various devices have been designed for coupling barges to each other or to a docking facility and which enable the floating barges to rise and fall with respect to each other due to the waves in the water. One of these devices is the "Flexible Connection for Articulating Vessels", detailed in U.S. Pat. No. 3,938,461, dated Feb. 17, 1976, to Marriner. The device is characterized by one or more resilient posts which are interposed between adjacent vessels, typically components of a barge string, to removably connect the vessels in an articulated manner. The resilient posts flex and bend to accommodate roll, pitch, yaw, surge and heave motions between the vessels due to wave action. U.S. Pat. No. 3,981,517, dated Sep. 21, 1976, to Gerald J. Crochet, Sr., details a coupling mechanism which is used to couple a pair of vehicles to each other, which mechanism permits universal relative movement of the vehicles with respect to each other. The mechanism is characterized by an elongated arm having multiple articulating segments which are capable of pivoting and rotating with respect to each other, the ends of which arm attached to the respective vehicles. A "Mechanical Coupling for Marine Vehicles" is disclosed in U.S. Pat. No. 4,066,030, dated Jan. 3, 1978, to Milone. The Milone coupling is characterized by a mechanical coupling for connecting marine vehicles to each other or to a dock. The coupling includes male and female members mounted on respective vehicles or to a dock and the vehicle, respectively, and may be quickly and easily connected and disconnected, as desired. The female member includes a vertical track of substantial length through which the male member extends, thereby permitting relative vertical movement of the male member in the female member to compensate for the rise and fall of the vehicle in the water. U.S. Pat. No. 4,521,044, dated Jun. 4, 1985, to Appleman, et al., describes a "Twistlock Operator" having a drive mechanism with a fixed axis and an angularly-displaceable twistlock having a pivot axis normally positioned along the fixed axis. A first actuator is drivingly connected to the drive mechanism for permitting rotation of the first actuator, and a second actuator is connected to the twistlock. Each of the actuators is generally rectangularly shaped and each has arcuate side bearing surfaces, each of which has substantially equal radii of curvature. A tube is pivotally connected to each of the actuators for drivingly connecting the actuators to each other, thus causing cooperative rotation of the actuators. U.S. Pat. No. 5,150,744, dated Sep. 29, 1992, to Hayashi, et al., describes a "Mooring Apparatus", characterized by a pair of sliding members which vertically and slidably engage respective engagement members disposed in a pair of dophins. The engagement members can freely move in a horizontal direction. The dolphins are provided with fenders which receive the engagement members by elastic force to absorb the rocking of a ship in forward and backward directions, as well as in right and left broadside directions. A "Compliant Platform with Slide Connection Docking to Auxiliary Vessel" is detailed in U.S. Pat. No. 5,423,632, dated Jun. 13, 1995, to Ekvall, et al. According to the method of the invention, a compliant platform is installed adjacent to a selected well site and an auxiliary vessel is temporarily docked to the compliant platform to provide for support for the well operations which will be produced through the compliant platform. The compliant platform is isolated from vertical loads upon the auxiliary vessel docked thereto during the performance of well operations conducted for the compliant platform by the offshore auxiliary vessel. A "Bumper docking Between Offshore Drilling Vessels and Compliant Platforms" is described in U.S. Pat. No. 5,439,324, dated Aug. 8, 1995, to Ekvall, et al. The docking is characterized by first and second pads having vertically-extending, complementary outboard faces extending from the respective structures in vertically-slidable abutment. A biasing system pushes the vessel and platform into abutment across the first and second pads and the system allows the vessel to dock to the structure in a manner such that vertical loading is not substantially transmitted between the vessel and the structure across the sliding engagement. U.S. Pat. No. 5,439,991, dated Feb. 27, 1995, to Wright, et al., details an "Apparatus for Securing a Watercraft to a Dock". The apparatus controls horizontal movement of the watercraft but allows free vertical movement with the rise and fall of the water supporting the watercraft. The apparatus includes a longitudinal beam attached to the dock in generally vertical orientation and a channel member that is slidably carried by the beam. A first arm and a second arm are longitudinally joined by a flexible connector and the free end of the first arm is attached to the channel member. The apparatus further includes a guide including a fender and a longitudinal element that extends from the fender. The free end of the longitudinal element is attached to the free end of the second arm and a clamp is adjustably attached to the element. The clamp has structure thereon for attaching the clamp to a watercraft.

An object of this invention is to provide a reciprocating barge coupling device for coupling adjacent barges floating on a water body.

Another object of this invention is to provide a reciprocating barge coupling device for removably coupling adjacent barges floating on a water body and allowing typically wave-induced vertical movements of the coupled barges with respect to each other in the water.

Still another object of this invention is to provide a reciprocating barge coupling device characterized by a pair of coupling units which are mounted on respective adjacent barges and can reciprocally be used to connect one barge to the other.

Yet another object of this invention is to provide a reciprocating barge coupling device which is capable of coupling either of two adjacent barges to the other barge regardless of height discrepancy between the barges.

A still further object of this invention is to provide a reciprocating barge coupling device characterized by first and second coupling units of substantially identical construction mounted on respective adjacent barges and each having an elongated, vertical coupling channel and fitted with a T-bolt, wherein the barges are positioned in adjacent end-to-end relationship to each other, with the vertical coupling channel of the first coupling unit in substantially aligned and facing relationship with respect to the vertical coupling channel of the second coupling unit, and wherein the T-bolt of the coupling unit on the lower of the two barges can be selectively extended through the aligned coupling channel of both coupling units, rotated to cause engagement of the T-bolt head with the opposite, companion coupling unit on the higher barge and locked in place, to removably couple the barges to each other such that the extending T-bolt is capable of bidirectional vertical movement in the coupling channel of the receiving coupling unit, and the barges remain coupled to each other as the floating barges rise and fall with respect to each other typically due to the wave action in the water.

SUMMARY OF THE INVENTION

These and other objects of the invention are provided in a reciprocating barge coupling device for removably coupling adjacent barges in a barge string floating on a water body and allowing typically wave induced vertical movement of the coupled barges with respect to each other with the rise and fall of the water. In a preferred embodiment the reciprocating barge coupling device is characterized by first and second coupling units of substantially identical construction mounted on the respective barges, each of which coupling units is fitted with an elongated, vertical coupling channel and a T-bolt. In application, the floating barges are positioned in adjacent, end-to-end relationship to each other, with the vertical coupling channel of the first coupling unit in substantially aligned and facing relationship with respect to the vertical coupling channel of the companion second coupling unit. The T-bolt of the coupling unit on the lower of the two barges can be selectively extended through the registering vertical coupling channels of both coupling units, then partially rotated to cause engagement of the T-bolt head with the opposite or companion coupling unit on the higher barge and the T-bolt locked in place, to removably couple the barges to each other. If the respective barges are substantially the same height, the T-bolt of either coupling unit can be used in the coupling operation. Accordingly, the extended T-bolt of the first or second coupling unit is capable of bidirectional vertical movement in the vertical coupling channel of the opposite, receiving coupling unit, and the barges remain coupled to each other as the floating barges rise and fall with respect to each other typically due to the wave action in the water. Typically, a pair of the coupling units is provided at each end of each barge, in spaced-apart relationship to each other for engaging the respective coupling units on the adjacent end of the opposite barge.

BRIEF DESCRIPTION OF THE DRAWINGS

The invention will be better understood by reference to the accompanying drawings, wherein.

DESCRIPTION OF THE PREFERRED EMBODIMENTS

Figure 5:
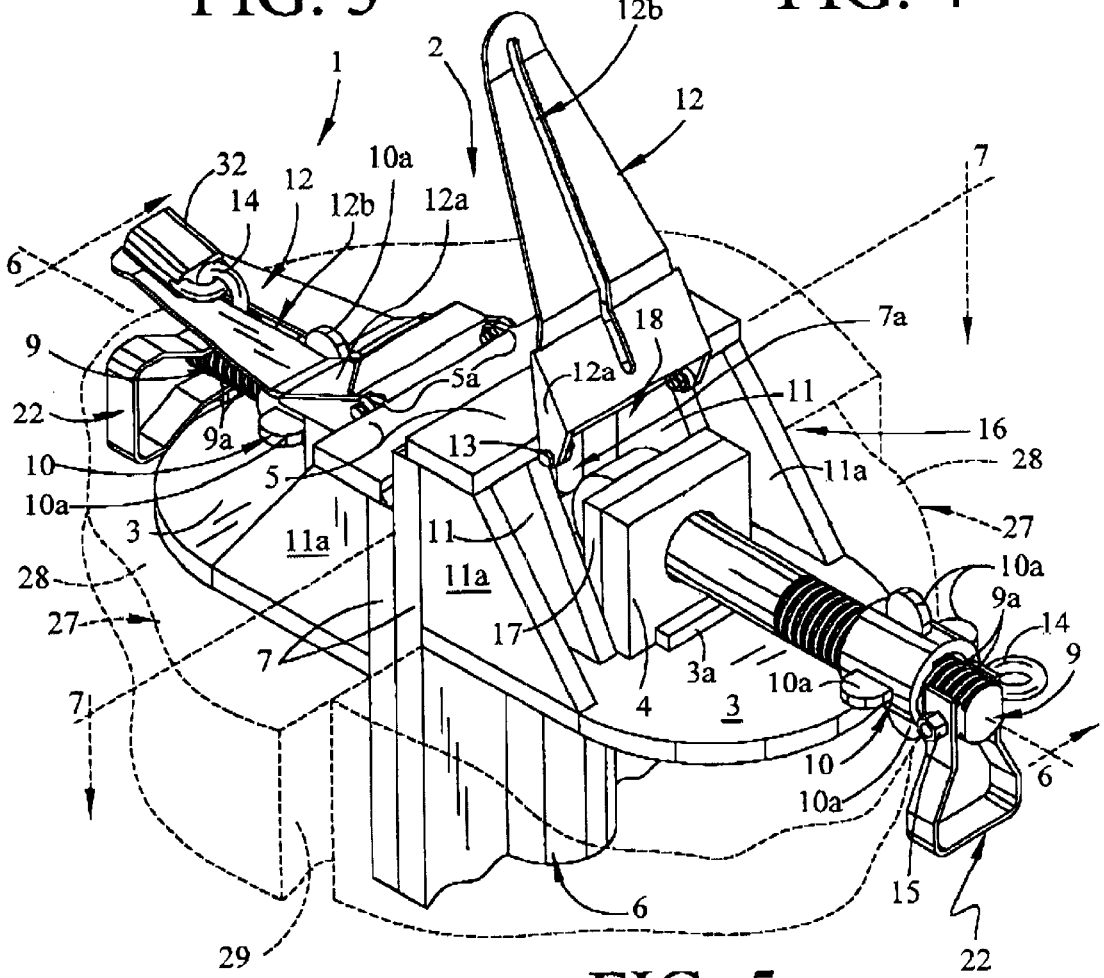
FIG. 5 is a perspective view of the first and second coupling units illustrated in FIGS. 3 and 4, partially in section and mounted on respective barges (illustrated partially in section by the phantom lines), more particularly illustrating coupling of adjacent barges of unequal height in typical application of the reciprocating barge coupling device.
Figure 11:
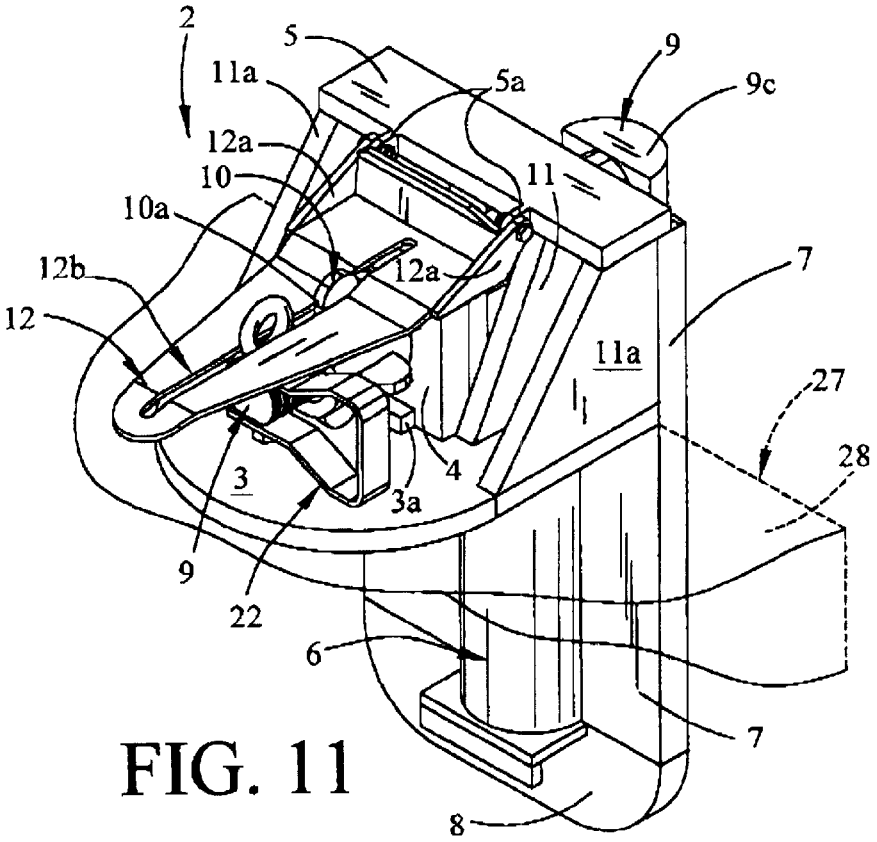
FIG. 11 is a rear perspective view, partially in section, of the first coupling unit, more particularly illustrating removable attachment of the stress plate element and the cushion plate element of the first coupling unit in typical application of the reciprocating barge coupling device.
Figure 12:
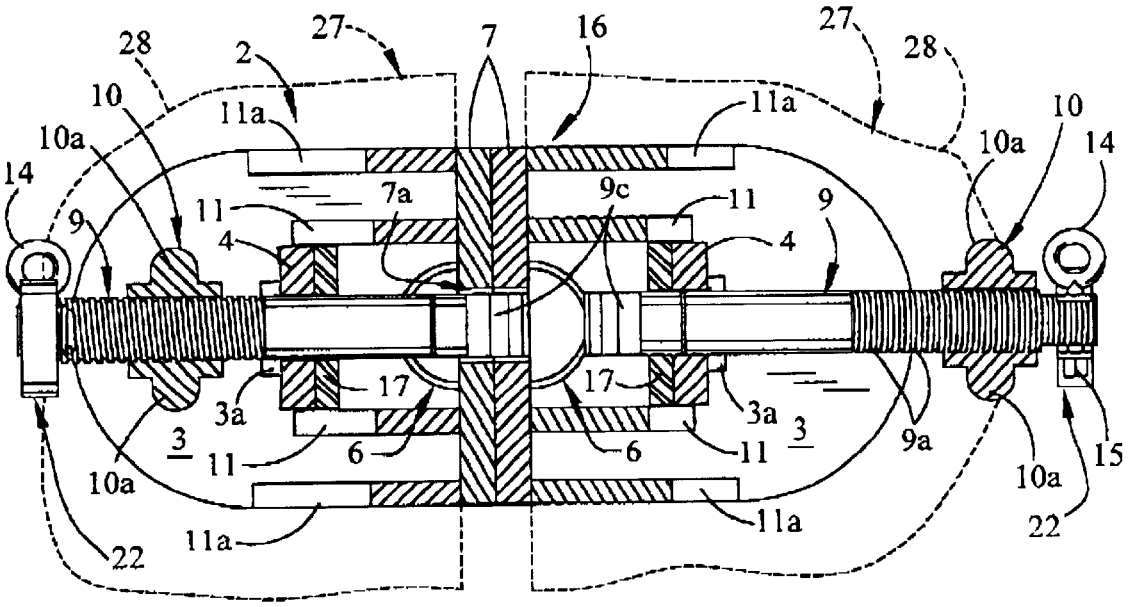
FIG. 12 is a sectional view, taken along section line 7—7 in FIG. 5, of the first and second coupling units, more particularly illustrating insertion of the T-bolt element of the first coupling unit through the aligned coupling channels of the coupling units in application of the reciprocating barge coupling device.
Figure 13:
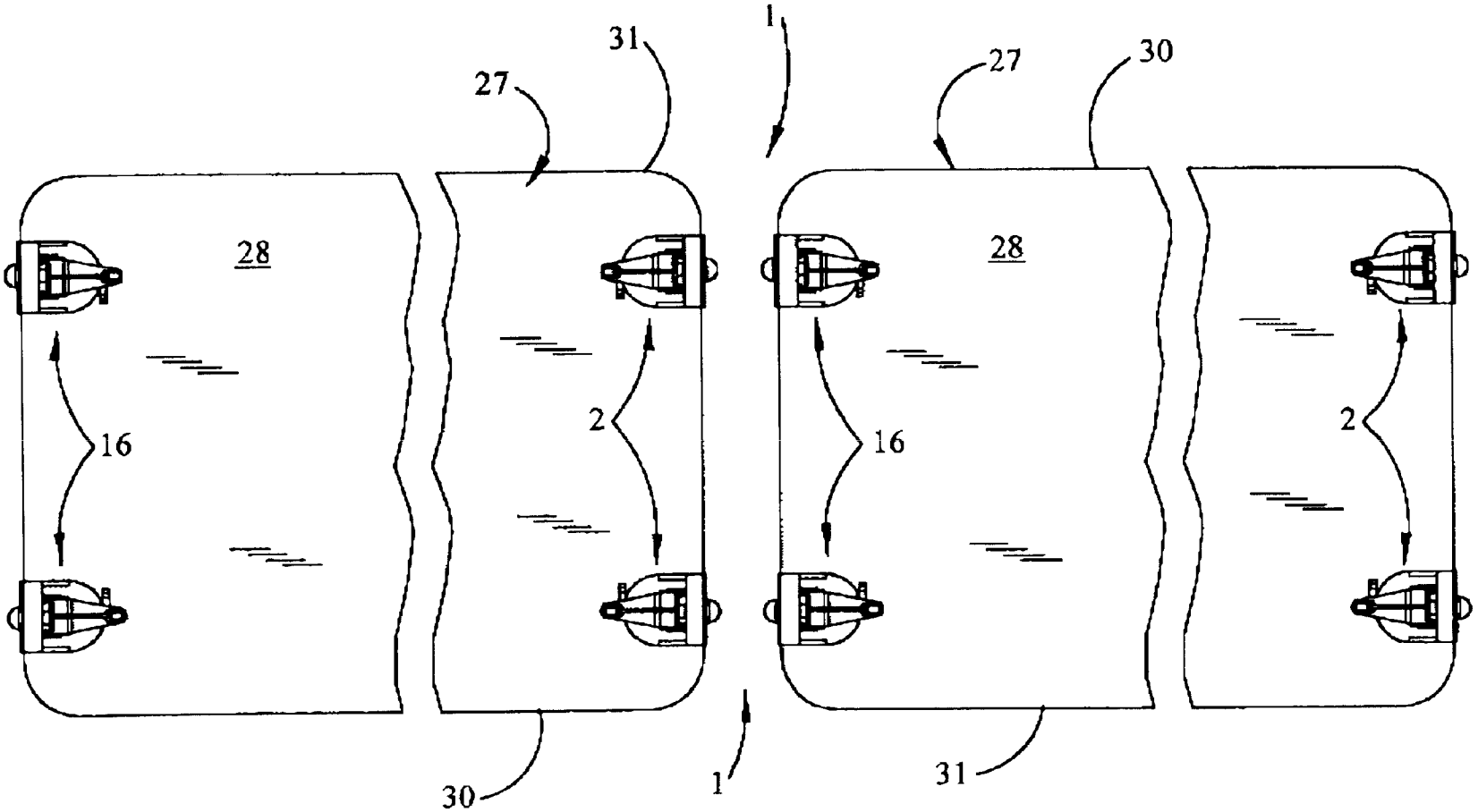
FIG. 13 is a top view, partially in section, of a pair of barges positioned in adjacent, end-to-end relationship to each other, with a pair of the coupling units mounted at each end of each barge in typical application of the reciprocating barge coupling device.

Referring initially to FIGS. 1, 2, 5 and 8–13 of the drawings, in a preferred embodiment the reciprocating barge coupling device of this invention is generally illustrated by reference numeral 1 in FIG. 5. The reciprocating barge coupling device 1 is designed to removably couple adjacent barges 27 (illustrated partially in section by the phantom lines in FIG. 5), floating on a water body such as a river (not illustrated), and allow slight vertical movements of the coupled barges 27 with respect to each other typically due to the wave action of the water. The reciprocating barge coupling device 1 is characterized by a first coupling unit 2 and a second coupling unit 16, substantially identical in construction with each other and mounted on the barge decks 28 of the respective barges 27, as illustrated in FIG. 13 and hereinafter described. Typically, a pair of the first coupling units 2 is mounted at one end of each barge 27, adjacent to the starboard side 30 and the port side 31, respectively, of the barge 27. A pair of the second coupling units 16 is mounted at the other end of each barge 27, adjacent to the starboard side 30 and the port side 31, respectively, of the barge 27 for engaging the respective, companion first coupling units 2 on the adjacent barge 27. The first coupling unit 2 and second coupling unit 16 each includes a generally U-shaped base plate 3, which rests on and is typically welded or otherwise attached to the upper surface of the barge deck 28 of the corresponding barge 27, as illustrated in FIG. 5, with the front edge (not illustrated) of the base plate 3 substantially flush with the internal surface of the end bulkhead 29 of the barge 27. A stress plate stop 3*a* the purpose of which will be hereinafter described is typically welded to the upper surface of the base plate 3 in substantially transversely centered relationship to the base plate 3. A channel beam 6, having a generally semicircular cross-sectional configuration, extends downwardly from a correspondingly-shaped plate slot (not illustrated) provided in the base plate 3, which is typically welded to the upper end portion of the channel beam 6. The channel beam 6 is typically welded or otherwise secured further, in a channel (not illustrated) which is cut vertically through substantially the entire thickness of the barge deck 28, end bulkhead 29 and internal bracing (not illustrated), of the corresponding barge 27. An elongated, substantially rectangular coupling plate 7 is typically welded to each side of channel beam 6 in spaced apart parallel relationship to each other and in substantially bisectional relationship to the curvature form of the channel beam 6, as further illustrated in FIG. 10, and the coupling plates 7 with the attached channel beam 6 typically extending vertically along substantially the entire length of the end bulkhead 29 of the corresponding barge 27, and the upper end portion of the coupling plates 7 protruding vertically above the barge deck 28 of the barge 27, as particularly illustrated in FIG. 9. An elongated, substantially semicircular vertical coupling channel 7*a,* the purpose of which will be hereinafter described, is defined between and behind the adjacent parallel coupling plates 7. A generally semicircular finish plate 8 is typically welded to the respective coupling plates 7 at the lower ends thereof with the outer edges of the finish plate 8 essentially in alignment with the outer edges of the coupling plates 7. As illustrated in FIG. 11, a pair of generally trapezoidal inside gusset braces 11 are typically welded to the coupling plates 7 and the base plate 3 in parallel spaced apart relationship to each other and perpendicular relationship to the coupling plates 7 and the base plate 3 on substantially each side of the coupling channel 7*a.* Another pair of generally trapezoidal outside gusset braces 11*a* are typically welded to the coupling plates 7 and the base plate 3 in parallel spaced apart relationship to each other and the inside gusset braces 11, adjacent to the respective outer edges of the base plate 3 and coupling plates 7. A generally rectangular top plate 5 is typically welded on the top surfaces of the respective coupling plates 7, inside gusset braces 11, and outside gusset braces 11*a*. A pair of generally rounded hinge extensions 5*a* are typically welded to the inboard edge of the top plate 5 in parallel spaced apart relationship to each other for purposes hereinafter described. A substantially square stress plate recess 18 is framed by the base plate 3, inside gusset braces 11 and the top plate 5 as further illustrated in FIG. 10 for purposes hereinafter described.

Figure 4:
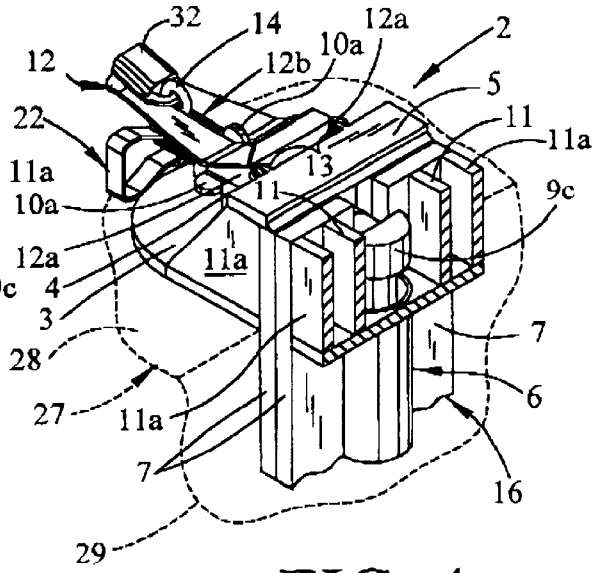
FIG. 4 is a perspective view, partially in section, of the first coupling unit and second coupling unit (partially in section) illustrated in FIG. 3, more particularly illustrating partial rotation of the T-bolt element of the first coupling unit to facilitate engagement of the T-bolt with the second coupling unit and removable coupling of the first and second coupling units to each other, in typical application of the reciprocating barge coupling device.
Figure 8:
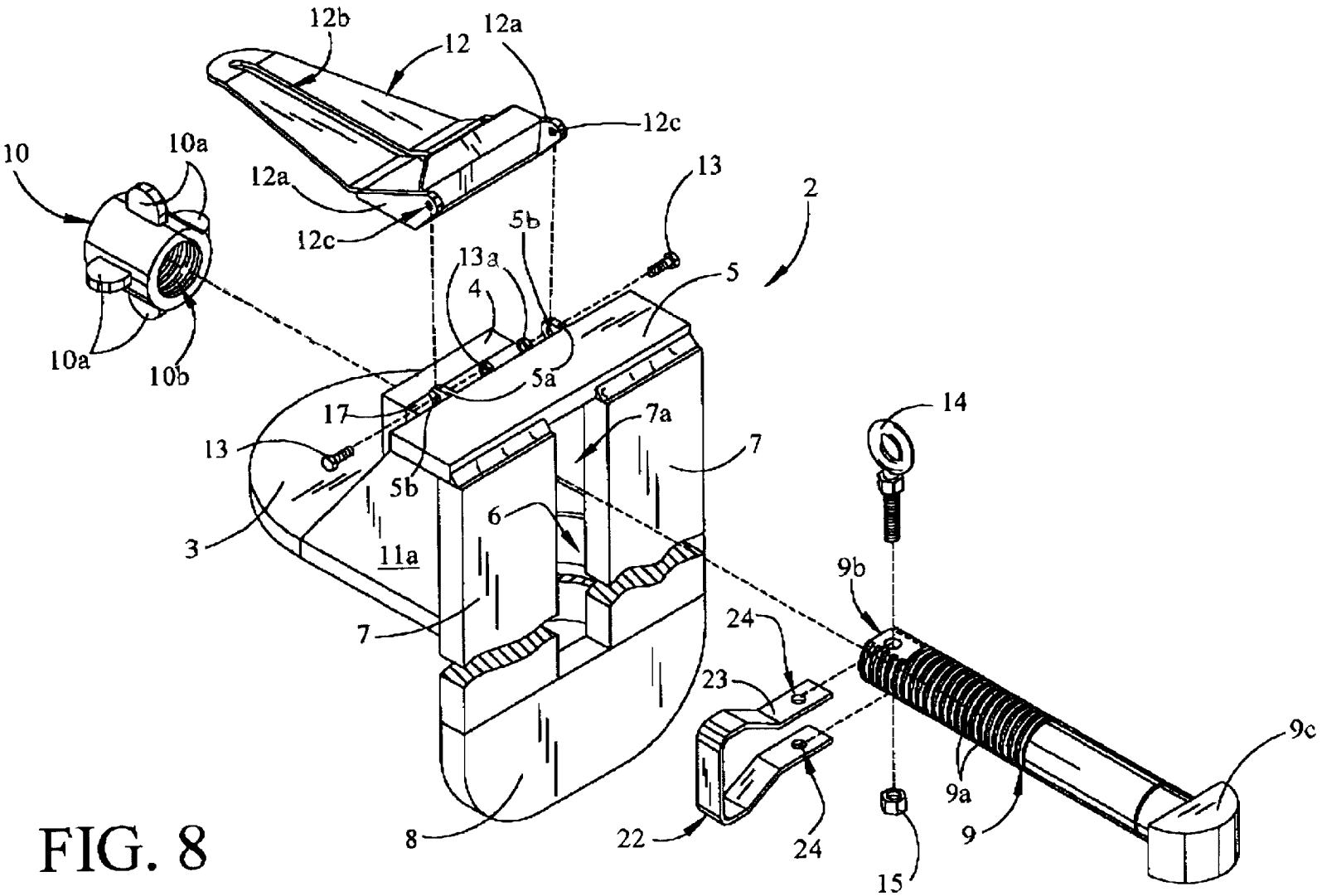
FIG. 8 is an exploded, front perspective view, partially in section, of the first coupling unit of the reciprocating barge coupling device, more particularly illustrating a preferred technique for mounting a T-bolt rotation handle on the T-bolt element of the coupling unit.
Figure 9:
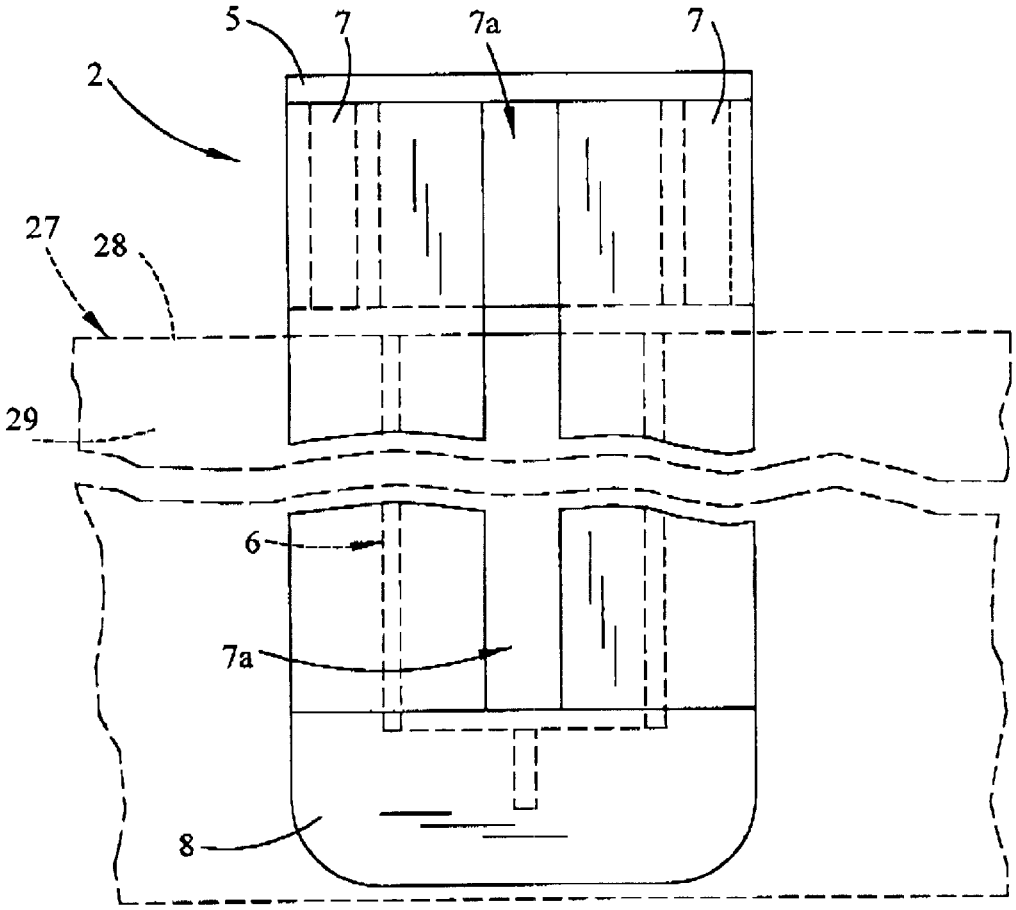
FIG. 9 is a front view, partially in section, of the first coupling unit, mounted on a barge (in phantom, shown partially in section)
Figure 10:
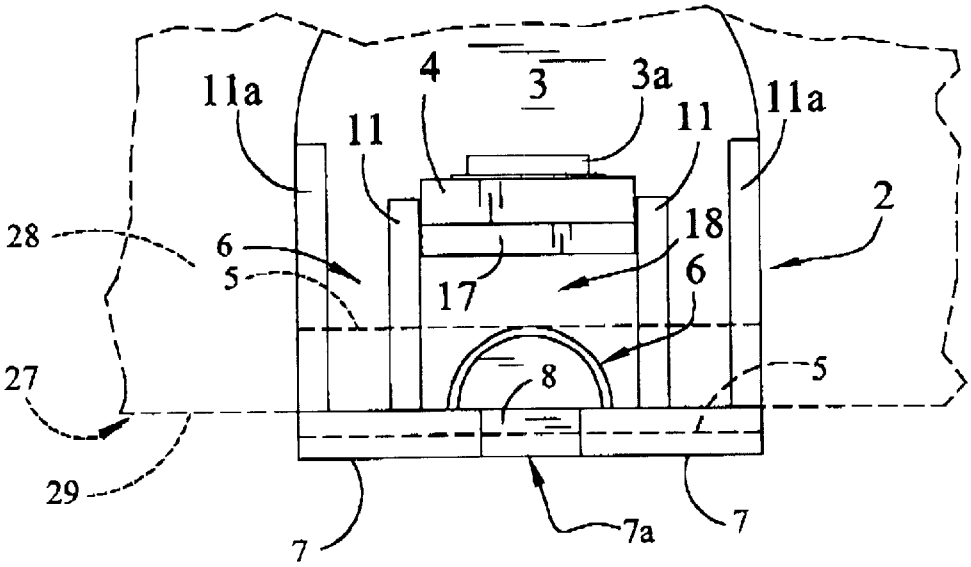
FIG. 10 is a top view of the first coupling unit illustrated in FIG. 9.

As further illustrated in FIG. 5, the first coupling unit 2 and second coupling unit 16 are each fitted with a T-bolt 9, having T-bolt threads 9*a* at one end, and having an elongated T-bolt head 9*c* on the opposite end portion of the T-bolt 9, as particularly illustrated in FIGS. 8 and 11. The T-bolt 9 extends through a central cushion plate opening (not illustrated) provided in a typically square cushion plate 17, which is made of compressible material such as rubber, and through a central stress plate opening (not illustrated) provided in a typically square stress plate 4, which is made of steel. A hammer nut 10, having an interiorly-threaded not bore 10*b* and fitted with multiple, extending nut flanges 10*a,* is threaded on the T-bolt threads 9*a* of the T-bolt 9. An eye bolt 14 extends through an eye bolt opening 9*b,* provided in the T-bolt 9 at the threaded end portion thereof, as further illustrated in FIG. 8, and is secured on the T-bolt 9 typically by means of a nut 15, threaded on the lower end of the eye bolt 14. The eye bolt 14 typically further extends through aligned eye bolt openings 24, provided in the respective handle flanges 23 of a T-bolt rotation handle 22, which is grasped to partially rotate the T-bolt 9 in application of the reciprocating barge coupling device 1 as hereinafter described. An elongated lock hasp 12 is pivotally mounted on the hinge extensions 5*a* typically by means of a pair of bolts 13, which, as further illustrated in FIG. 8, are extended through responsive bolt openings 12*c* in the hasp flanges 12*a* of the lock hasp 12 and through the respective hinge extension openings 5*b* provided in the hinge extensions 5*a,* and is secured on the hinge extensions 5*a* typically by means of a pair of nuts 13*a*. The lock hasp 12 is fitted with an elongated hasp slot 12*b* which, when the lock hasp 12 is in the lowered position illustrated in FIGS. 4 and 5, removably receives the eye bolt 14 extending through the T-bolt 9 and one of the nut flanges 10*a* of the hammer nut 10. A padlock 32 is optionally secured on the eye bolt 14 as illustrated in FIG. 5 to prevent inadvertent removal of the lock hasp 12 from the eye bolt 14 and the nut flange 10*a* and rotation of the T-bolt 9 for purposes which will be hereinafter described. Since the T-bolt 9 of only one of the first coupling unit 2 and second coupling unit 16 is used to couple the adjacent barges 27, the T-bolt head 9*c* of the T-bolt 9 of the first coupling unit 2 or second coupling unit 16 having the T-bolt 9 which is not used in the coupling operation is typically retracted from the corresponding first coupling unit 2 or second coupling unit 16, with the corresponding cushion plate 17 and stress plate 4, as illustrated with respect to the second coupling unit 16 in FIG. 6.

Figure 1:
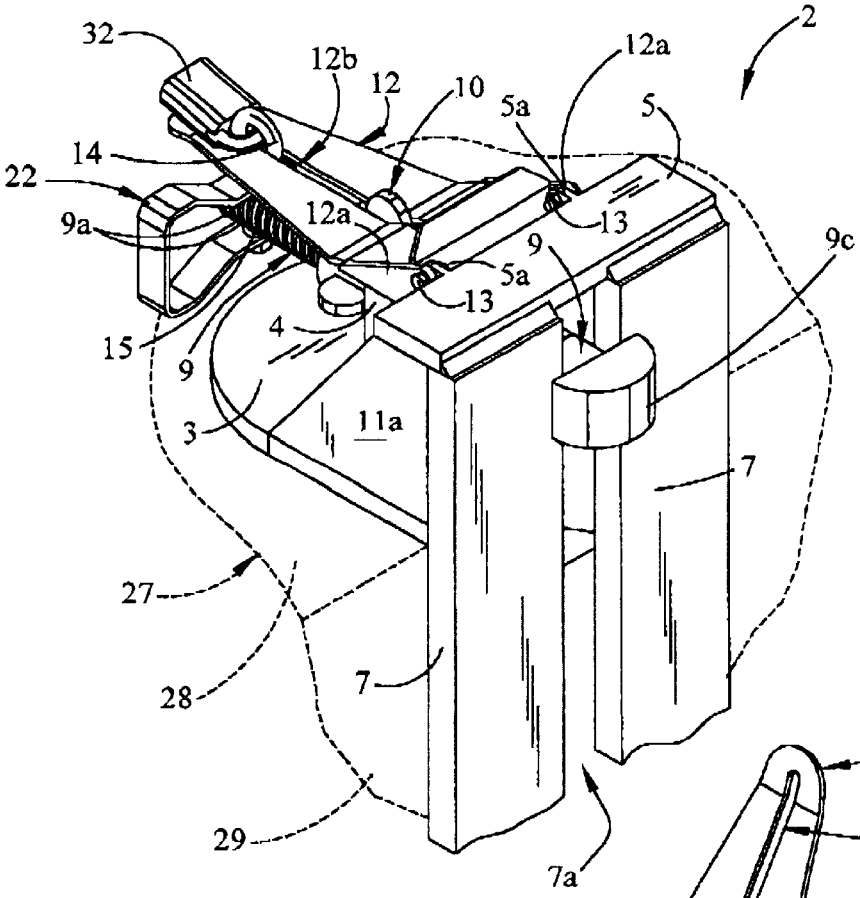
FIG. 1 is a front perspective view, partially in section, of a first coupling unit element of a preferred embodiment of the reciprocating barge coupling device of this invention, mounted on a first barge, illustrated in phantom and partially in section.
Figure 2:
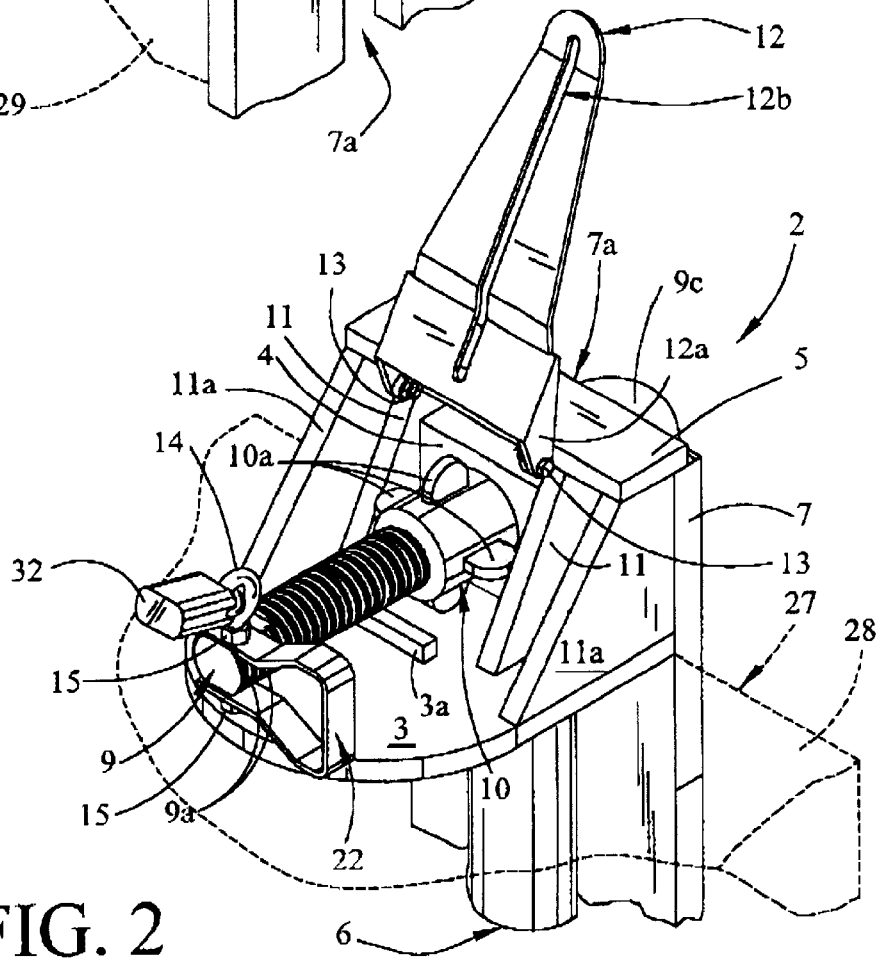
FIG. 2 is a rear perspective view of the first coupling unit illustrated in FIG. 1, more particularly illustrating a preferred design of the T-bolt rotation handle element of the coupling unit.
Figure 3:
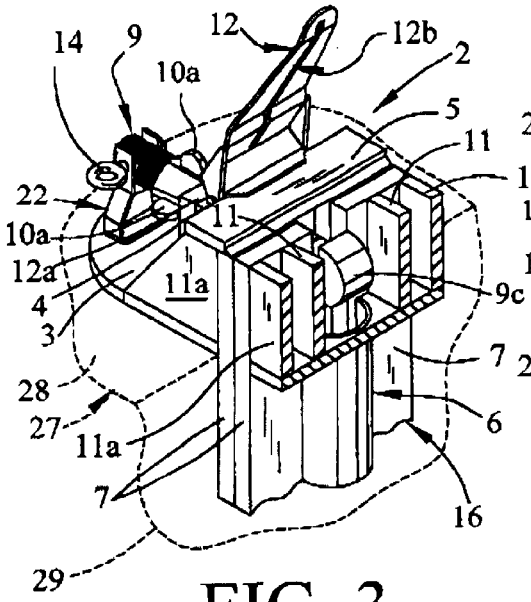
FIG. 3 is a perspective view, partially in section, of the first coupling unit illustrated in FIGS. 1 and 2, with a second coupling unit element (partially in section) of the reciprocating barge coupling device mounted on a second barge (not illustrated) and shown positioned in facing, adjacent relationship to the first coupling unit, more particularly illustration insertion of the T-bolt element of the first coupling unit through the aligned coupling channels of the respective first and second coupling units in typical application of the reciprocating barge coupling device.
Figure 6:
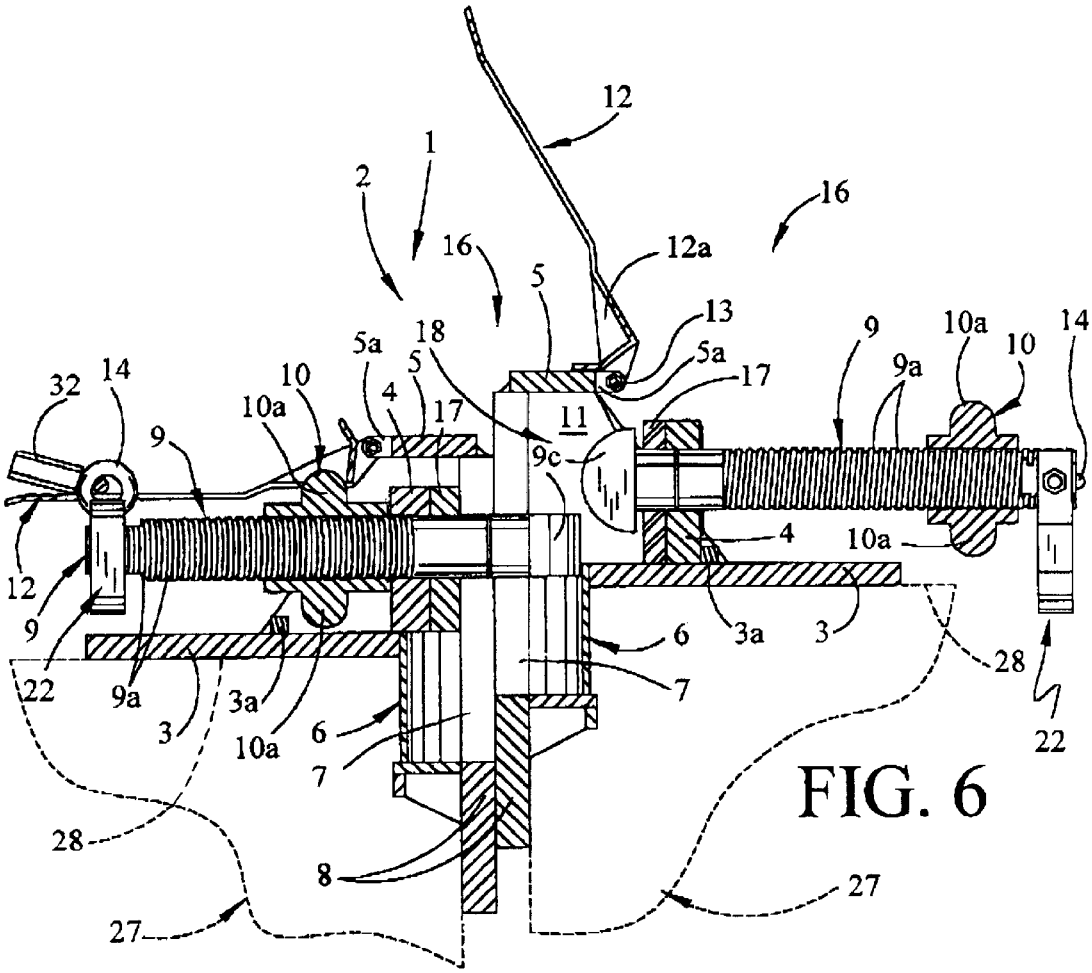
FIG. 6 is a sectional view, taken along section line 6—6 in FIG. 5, of the reciprocating barge coupling device.
Figure 7:
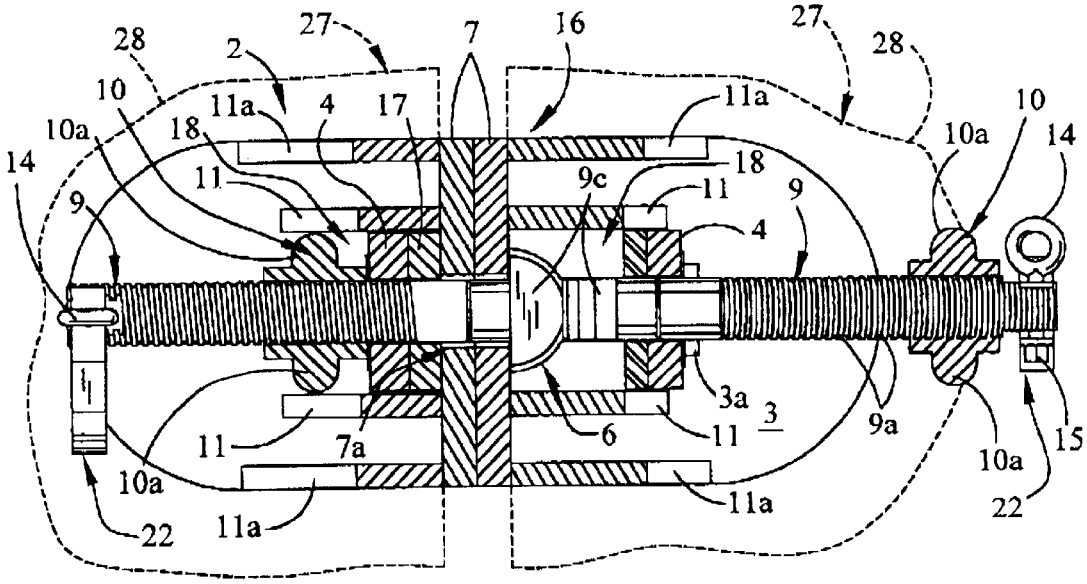
FIG. 7 is a sectional view, taken along section line 7—7 in FIG. 5, of the reciprocating barge coupling device.

Referring next to FIGS. 3–7 and 11–13 of the drawings, in application of the reciprocating barge coupling device 1, the barges 27 to be coupled together are initially positioned in adjacent, end-to-end relationship with respect to each other on the river or other water body (not illustrated), as illustrated in FIG. 13, such that the first coupling units 2 on one of the barges 27 are positioned in substantial alignment with the respective second coupling units 16 on the adjacent barge 27, as illustrated. The T-bolts 9 of the first coupling units 2 or second coupling units 16 which are mounted on the lower of the two barges 27 are typically the T-bolts 9 which are used to couple the barges 27. For example, as illustrated in FIG. 6 the T-bolt 9 of the first coupling unit 2 is used to couple the barges 27 if the barge deck 28 of the barge 27 on which the first coupling unit 2 is mounted is lower than the barge deck 28 of the barge 27 on which the second coupling unit 16 is mounted, as illustrated. The T-bolt 9 of the second coupling unit 16 is not used in the coupling operation. The first coupling unit 2 thus functions as the "male" component, and the second coupling unit 16 functions as the "female" component, of the reciprocating barge coupling device 1. Accordingly, the vertically aligned T-bolt head 9*c* of the T-bolt 9 and corresponding cushion plate 17 and stress plate 4 of the second coupling unit 16 is typically retracted from the second coupling unit 16 until the stress plate 4 essentially comes into contact with the stress plate stop 3*a* as illustrated in FIG. 6, and the vertically aligned T-bolt head 9*c* of the T-bolt 9 of the first coupling unit 2 is initially extended through the aligned vertical coupling channels 7*a* of the respective first coupling unit 2 and the second coupling unit 16, as illustrated in FIG. 3. Extension of the T-bolt 9 is continued until the horizontal T-bolt head 9*c* is positioned inside the coupling channel 7*a* of the second coupling unit 16, as illustrated in FIG. 6. The cushion plate 17 and the stress plate 4 of the first coupling unit 2 is then inserted into the corresponding stress plate recess 18 of the first coupling unit 2, as the stress plate 4 is rested on the base plate 3 as illustrated in FIG. 6. The T-bolt 9 is rotated 90 degrees typically by operation of the T-bolt rotation handle 22, thus rotating the T-bolt head 9*c* to the horizontal position illustrated in FIG. 4. The hammer nut 10 is next threaded on the T-bolt threads 9*a* of the T-bolt 9, against the stress plate 4 of the first coupling unit 2. This action draws the horizontal T-bolt head 9*c* against the parallel coupling plates 7 of the second coupling unit 16, as illustrated in FIG. 7, thereby causing engagement of the coupling plates 7 of the second coupling unit 16 against the respective coupling plates 7 of the first coupling unit 2 as the cushion plate 17 engages the coupling plates 7 of the first coupling unit 2. The second coupling unit 16 is thus coupled to the first coupling unit 2, by engagement of the horizontal T-bolt head 9*c* against the respective parallel, vertical coupling plates 7 of the second coupling unit 16 and the hammer nut 10 against the stress plate 4 of the first coupling unit 2. The lock hasp 12 of the first coupling unit 2 is next pivoted to the lowered horizontal position illustrated in FIGS. 4 and 5, such that the eye bolt 14 and an upwardly-extending nut flange 10*a* of the hammer bolt 10 extend upwardly through the hasp slot 12*b* of the lock hasp 12. Accordingly, inadvertent rotation of the T-bolt 9 and slipping of the horizontal T-bolt head 9*c* from the coupling channels 7*a* of the respective first coupling unit 2 and second coupling unit 16 is prevented by operation of the eyebolt 14 in the hasp slot 12*b* of the lock hasp 12. The padlock 32 is optionally extended through the eye bolt 14 and locked, to prevent inadvertent removal of the lock hasp 12 from the eye bolt 14 and nut flange 10*a* and rotation of the T-bolt 9. Other adjacent barges 27 in the barge string are typically coupled to each other as heretofore described, and the barge string can be moved on the water body in either direction typically by means of a standard or conventional propulsion unit (not illustrated) which typically pushes the coupled barges 27. Although stationary in the coupling channel 7*a* of the first coupling unit 2, the T-bolt 9 of the first coupling unit 2 is capable of bidirectional vertical displacement in the coupling channel 7*a* of the second coupling unit 16, as illustrated in FIG. 6, as the coupled barges 27 rise and fall with each other typically due to the wave action in the water. It will be appreciated by those skilled in the art that under circumstances in which the barge deck 28 on which the second coupling unit 16 is mounted is disposed at a lower level than the barge deck 28 on which the first coupling unit 2 is mounted, the second coupling unit 16 is typically the "male" component and the first coupling unit 2 is the "female" component of the reciprocating barge coupling device 1. In that case, the T-bolt 9 of the second coupling unit 16 is used to couple the barges 27, in the same manner as heretofore described with respect to the T-bolt 9 of the first coupling unit 2. If the barges 27 are substantially the same height, the T-bolt 9 of either the first coupling unit 2 or the second coupling unit 16 can be used in the coupling operation, since in that case the T-bolt 9 of either coupling unit is capable of interfacing with the coupling channel 7*a* of the opposite coupling unit. The adjacent barges 27 are uncoupled, as desired, by unlocking and removing the optional padlock 32 from the eye bolt 14, lifting the lock hasp 12 from the eye bolt 14 and the nut flange 10*a* of the hammer nut 10, threading the hammer nut 10 on the T-bolt 9 from contact with the stress plate 4, rotating the T-bolt head 9*c* from the horizontal to the vertical configuration by operation of the T-bolt rotation handle 22 on the T-bolt 9, and removing the vertical T-bolt head 9*c* from the aligned coupling channel 7*a* of the respective second coupling unit 16 and first coupling unit 2.

It will be appreciated by those skilled in the art that the reciprocating barge coupling device of this invention is simple in construction, inexpensive and easy to manufacture and securely couples adjacent barges or other marine vehicles floating on a water body while allowing slight vertical displacement of the barges with respect to each other typically due to the wave action of the water. It will be further appreciated by those skilled in the art that the substantially identical construction of the coupling units of the device enables the T-bolt of the coupling unit on either barge to be used to couple the barges, and this features is essential under circumstances in which barges having different deck heights must be coupled, due to the possibility of the T-bolt of one of the coupling units being on a higher level than the coupling channel of the opposite coupling unit. Accordingly, the T-bolt of the coupling unit of the lower barge is capable of interfacing with the vertical coupling slot of the coupling unit of the higher barge, irrespective of which coupling unit is mounted on which barge. It is understood that the coupling units of the reciprocating barge coupling device can be constructed in various sizes depending on the particular magnitude of the stress resistance desired.

While the preferred embodiments of the invention have been described above, it will be recognized and understood that various modifications can be made in the invention and the appended claims are intended to cover all such modifications which may fall within the spirit and scope of the invention.

Having described by invention with the particularity set forth above, what is claimed is:

1. A reciprocating barge coupling device for coupling a first marine vehicle to a second marine vehicle, said device comprising:

a pair of coupling units for attachment to the first marine vehicle and the second marine vehicle, respectively, said pair of coupling units each comprising an elongated coupling channel; and a T-bolt carried by a selected one of said pair of coupling units for removable extension through said coupling channel of the other of said pair of coupling units and engaging said other of said pair of coupling units, whereby said first marine vehicle and said second marine vehicle are capable of movement with respect to each other as said T-bolt couples said selected one of said pair of coupling units to said other of said pair of coupling units.

2. The reciprocating barge coupling device of claim 1 wherein said pair of coupling units each comprises a pair of coupling plates and said T-bolt is adapted for engaging said pair of coupling plates of said other of said pair of coupling units.

3. The reciprocating barge coupling device of claim 1 comprising a hammer nut threaded on said T-bolt for removably engaging said selected one of said pair of coupling units and securing said T-bolt against said other of said pair of coupling units.

4. The reciprocating barge coupling device of claim 3 wherein said pair of coupling units each comprises a pair of coupling plates and said T-bolt is adapted for engaging said pair of coupling plates of said other of said pair of coupling units.

5. The reciprocating barge coupling device of claim 1 comprising a lock mechanism provided on said selected one of said pair of coupling units for selectively locking said T-bolt in engagement with said other of said pair of coupling units.

6. The reciprocating barge coupling device of claim 5 wherein said pair of coupling units each comprises a pair of coupling plates and said T-bolt is adapted for engaging said pair of coupling plates of said other of said pair of coupling units.

7. The reciprocating barge coupling device of claim 5 comprising a hammer nut threaded on said T-bolt for removably engaging said selected one of said pair of coupling units and securing said T-bolt against said other of said pair of coupling units.

8. The reciprocating barge coupling device of claim 7 wherein said pair of coupling units each comprises a pair of coupling plates and said T-bolt is adapted for engaging said pair of coupling plates of said other of said pair of coupling units.

9. A reciprocating barge coupling device for coupling a first marine vehicle to a second marine vehicle, said device comprising:

a pair of coupling units for attachment to the first marine vehicle and the second marine vehicle, respectively, said pair of coupling units each comprising an elongated coupling channel;

a T-bolt carried by a selected one of said pair of coupling units for removable extension through said coupling channel of the other of said pair of coupling units and engaging said other of said pair of coupling units, whereby said first marine vehicle and said second marine vehicle are capable of movement with respect to each other as said T-bolt couples said selected one of said pair of coupling units to said other of said pair of coupling units;

a lock mechanism provided on said selected one of said pair of coupling units for selectively locking said T-bolt in engagement with said other of said pair of coupling units; and a T-bolt rotation handle carried by said T-bolt for rotating said T-bolt on said selected one of said pair of coupling units.

10. The reciprocating barge coupling device of claim 9 wherein said pair of coupling units each comprises a pair of coupling plates and said T-bolt is adapted for engaging said pair of coupling plates of said other of said pair of coupling units.

11. The reciprocating barge coupling device of claim 9 comprising a hammer nut threaded on said T-bolt for removably engaging said selected one of said pair of coupling units and securing said T-bolt against said other of said pair of coupling units.

12. The reciprocating barge coupling device of claim 11 wherein said pair of coupling units each comprises a pair of coupling plates and said T-bolt is adapted for engaging said pair of coupling plates of said other of said pair of coupling units.

13. A reciprocating barge coupling device for coupling a first marine vehicle to a second marine vehicle, said device comprising:

a pair of coupling units for attachment to the first marine vehicle and the second marine vehicle, respectively, said pair of coupling units each comprising an enlongated coupling channel;

a T-bolt carried by a selected one of said pair of coupling units for removable extension through said coupling channel of the other of said pair of coupling units and engaging said other of said pair of coupling units, whereby said first marine vehicle and said second marine vehicle are capable of movement with respect to each other as said T-bolt couples said selected one of said pair of coupling units to said other of said pair of coupling units; and a lock hasp carried by said pair of coupling units, respectively, for selectively engaging said T-bolt and preventing rotation of said T-bolt on said selected one of said pair of coupling units.

14. The reciprocating barge coupling device of claim 13 wherein said pair of coupling units each comprises a pair of coupling plates and said T-bolt is adapted for engaging said pair of coupling plates of said other of said pair of coupling units.

15. The reciprocating barge coupling device of claim 13 comprising a hammer nut threaded on said T-bolt for removably engaging said selected one of said pair of coupling units and securing said T-bolt against said other of said pair of coupling units, and wherein said lock hasp engages said hammer nut.

16. The reciprocating barge coupling device of claim 15 wherein said pair of coupling units each comprises a pair of coupling plates and said T-bolts is adapted for engaging said pair of coupling plates of said other of said pair of coupling units.

17. A reciprocating barge coupling device for coupling a first marine vehicle to a second marine vehicle, said device comprising a first coupling unit for attachment to the first marine vehicle and a second coupling unit for attachment to the second marine vehicle, respectively, said first coupling unit and said second coupling unit each comprising:

an elongated vertical coupling channel;

a first T-bolt carried by said first coupling unit for selective removable extension through said vertical coupling channel of said second coupling unit and removably engaging said second coupling unit responsive to rotation of said first T-bolt on said first coupling unit; and a second T-bolt carried by said second coupling unit for selective removable extension through said vertical coupling channel of said first coupling unit and removably engaging said first coupling unit responsive to rotation of said second T-bolt on said second coupling unit, whereby said second marine vehicle is capable of vertical movement with respect to said first marine vehicle as a selected one of said first T-bolt and said second T-bolt couples said first coupling unit to said second coupling unit.

18. The reciprocating barge coupling device of claim 17 wherein said first coupling unit and said second coupling unit each comprises a pair of coupling plates and said first T-bolt is adapted for engaging said pair of coupling plates of said second coupling unit and said second T-bolt is adapted for engaging said pair of coupling plates of said first coupling unit.

19. The reciprocating barge coupling device of claim 18 comprising a first hammer nut threaded on said first T-bolt for removably engaging said first coupling unit and securing said first T-bolt against said second coupling unit and a second hammer nut threaded on said second T-bolt for removably engaging said second coupling unit and securing said second T-bolt against said first coupling unit.

20. A reciprocating barge coupling device for coupling a first barge to a second barge, said device comprising a pair of coupling units for attachment to the first barge and the second barge, respectively, said pair of coupling units comprising:

a base plate for attachment to the first barge and the second barge, respectively;

an elongated substantially semicircular channel beam extending from said base plate downward for substantially vertical mounting in the first barge and the second barge, respectively;

an elongated vertical coupling channel defined by said channel beam; and a T-bolt carried by a selected one of said pair of coupling units for removable extension through said vertical coupling channel of the other of said pair of coupling units and engaging said other of said pair of coupling units responsive to rotation of said T-bolt on said selected one of said pair of coupling units, whereby said second barge is capable of vertical movement with respect to said first barge as said T-bolt couples said selected one of said pair of coupling units to said other of said pair of coupling units.

* * * * *